US006479773B2

(12) United States Patent
Bienvenu

(10) Patent No.: US 6,479,773 B2
(45) Date of Patent: Nov. 12, 2002

(54) AXIAL-COMPRESSION SPRING ELECTRICAL CONTACT HAVING AN IMPERVIOUS CONNECTION

(75) Inventor: Didier Bienvenu, Champigny-sur-Marne (FR)

(73) Assignee: Societe d'Exploitation des Procedes Marechal (SEPM), Societe Anonyme, Saint-Maurice Cedex (FR)

( * ) Notice: Subject to any disclaimer, the term of this patent is extended or adjusted under 35 U.S.C. 154(b) by 0 days.

(21) Appl. No.: 09/884,926

(22) Filed: Jun. 21, 2001

(65) Prior Publication Data

US 2002/0020615 A1 Feb. 21, 2002

(30) Foreign Application Priority Data

Jun. 22, 2000 (FR) ..... 00 08006

(51) Int. Cl.[7] ..... H01R 13/24

(52) U.S. Cl. ..... 200/275; 200/239; 200/284; 200/290; 439/700; 439/447

(58) Field of Search ..... 200/239, 275, 200/284, 290; 439/447, 587, 700, 824, 289

(56) References Cited

U.S. PATENT DOCUMENTS 4,176,905 A * 12/1979 Marechal ..... 174/128.1
4,743,201 A * 5/1988 Robinson et al. ..... 439/10
5,131,870 A * 7/1992 El-Haj ..... 439/638
5,879,198 A * 3/1999 Sekimori et al. ..... 439/289
6,275,054 B1 * 8/2001 Boyle ..... 324/158.1

FOREIGN PATENT DOCUMENTS

| | | | |
|---|---|---|---|
| DE | 9412635 | 12/1994 | ..... H01R/13/52 |
| DE | 19900201 | 5/2000 | ..... H01R/13/58 |
| FR | 1398945 | 4/1964 | ..... H01R/13/52 |
| FR | 2545993 | 11/1984 | ..... H01R/35/00 |
| FR | 2709025 | 2/1995 | ..... H01R/13/24 |
| FR | 2768897 | 3/1999 | ..... H05K/3/36 |

* cited by examiner

*Primary Examiner*—Michael Friedhofer
(74) *Attorney, Agent, or Firm*—Greenblum & Bernstein, P.L.C.

(57) ABSTRACT

Electrical contact having an impervious connection, adapted to be housed in a guiding shaft open at its two ends, the contact comprising a terminal, a member and a deformable conductor. A movable contact head is connected to the terminal for connecting the member by way of the deformable conductor. A retaining element is fixed to the deformable conductor, a helical spring surrounding the deformable conductor and being supported at a first end on the contact head and at a second end on the retaining element. The contact head is biased by the helical spring working in compression. At least one stationary tubular gasket surrounds the terminal, at least partially, so as to encircle the member.

20 Claims, 1 Drawing Sheet

AXIAL-COMPRESSION SPRING ELECTRICAL CONTACT HAVING AN IMPERVIOUS CONNECTION

CROSS-REFERENCE TO RELATED APPLICATIONS

The instant application is based upon the French priority Patent Application No. 00 08006, filed Jun. 22, 2000, the disclosure of which is hereby expressly incorporated by reference thereto, and the priority of which is hereby claimed under 35 U.S.C. §119.

BACKGROUND OF THE INVENTION

1. Field of the Invention

The present invention relates to an axial-compression spring electrical contact having an impervious connection.

2. Background and Material Information

Axial-compression spring electrical contacts are well known and frequently used, in particular, to equip surface sockets or a coupler socket.

They each have an element, or contact head, which is subject to translations of a certain amplitude in a guiding shaft provided in an insulating portion of the apparatus to be equipped, and which, therefore, must be connected to a terminal for connecting a feeding cable by a deformable conductor.

The contact head is adapted to elastically engage, under the action of a helical spring, with an opposing contact that is rigid, or also elastic, and arranged, for example, in a plug or an appliance inlet. The aforementioned helical spring, which is housed in the guiding shaft and works in compression, surrounds the deformable conductor and is supported, at each of its ends, on a bearing surface of the connecting terminal and a bearing surface of the contact head, respectively.

The known electrical contacts of this type use, as a deformable conductor, a metallic braid which can be deformed by compression.

However, it is readily understood that in this type of contact, the terminal for connecting the feeding cable cannot itself ensure imperviousness at the level of this connection.

To ensure the imperviousness of a certain volume, it is known to fill it with a liquid material that can be polymerized.

However, this process is long and requires expensive implementing machines and materials.

In addition, the materials are often perishable, dangerous, and their high densities lead to a heavy final product.

Moreover, such a process generates constraints during the design of the zones to be sealed, with all the drawbacks, in addition to those mentioned hereinabove, that can result therefrom, such as the incorrect filling of the zones and burrs due to substantial clearances between the pieces in the zones to be sealed, etc.

SUMMARY OF THE INVENTION

This is why, to render the connection impervious, without requiring the aforementioned process, the invention proposes an axial-compression spring electrical contact having an impervious connection, adapted to be housed in a guiding shaft open at its two ends, arranged in an apparatus to be equipped, and including a movable contact head connected to a terminal for connecting a feeding cable by a deformable conductor, the contact head being biased by a helical spring working in compression which surrounds the deformable conductor and takes support, at each of its ends, on the contact head and on a retaining element, respectively, which retaining element is housed in the bottom of the guiding shaft and is fixed to the deformable conductor. The contact is characterized in that at least one tubular gasket is immobilized in the bottom of the guiding shaft, extends through this bottom and surrounds the connecting terminal, at least partially, so as to encircle the outer sheath of the feeding cable.

In addition to eliminating the aforementioned drawbacks, it is understood that the contacts can be prepared and arranged in the apparatus in advance, and then connected to the gaskets by using conventional tools, whereas the gaskets, which are compact, concurrently ensure an electrical insulation between the various contacts.

Advantageously, the gasket has an annular lip arranged between the retaining element, or a portion connected thereto, and the bottom of the guiding shaft, such that an axial pressure from the helical spring is exerted on the lip and, according to one embodiment, the retaining element fixed to the deformable conductor includes at least one washer that is supported on the annular lip of the gasket.

In the known conventional contacts, the retaining element constitutes the terminal for connecting to the electric feeding cable.

However, according to a quite particular and advantageous embodiment making it possible to also ensure a connection that can be oriented in order to facilitate the positioning of the feeding cable in the apparatus to be equipped, which is particularly advantageous when the cable is rigid or semi-rigid and non-coaxial upon contact, the retaining element is a sleeve which is fixed to the deformable conductor and is crossed by an extension of the deformable conductor at the end of which the terminal for connecting to the electric feeding cable is arranged, such that the terminal can be oriented due to the flexibility of the deformable conductor.

One understands the increased advantage of the gasket according to the invention for this type of embodiment, since one obtains an adjustable connection which can be impervious or electrically insulated.

To complete the imperviousness, the contact head can be further provided with an O-ring joint.

As mentioned previously, the deformable conductor, which can be of any type, is generally in the form of a braid which can be deformed by compression.

According to the invention, an electrical contact having an impervious connection, is adapted to be housed in a guiding shaft open at its two ends, the contact comprising a terminal, a member, and a deformable conductor. The movable contact head is connected to the terminal for connecting the member by way of the deformable conductor. A retaining element is fixed to the deformable conductor. A helical spring surrounds the deformable conductor and is supported at a first end on the contact head and at a second end on the retaining element, the contact head being biased by the helical spring working in compression. At least one stationary tubular gasket surrounds the terminal, at least partially, so as to encircle the member.

According to another aspect of the invention, the at least one stationary tubular gasket may be mounted in a bottom of the guiding shaft and may extend through the bottom of the guiding shaft. The at least one stationary tubular gasket may have an annular lip arranged between at least one of the retaining element and a portion connected thereto, and the bottom of the guiding shaft, such that an axial pressure from the helical spring is exerted on the lip. The retaining element may comprise at least one washer that is supported on the annular lip of the at least one stationary tubular gasket.

According to another embodiment of the invention, the retaining element may comprise a sleeve which is fixed to the deformable conductor and is crossed by an extension of the deformable conductor at the end of which the terminal for connecting to the member is arranged, such that the terminal can be oriented due to the flexibility of the deformable conductor.

The contact head may be further provided with an O-ring joint. The deformable conductor may be in the form of a braid which can be deformed by compression.

According to an aspect of the invention, an electrical contact having an impervious connection is adapted to be housed in a guiding shaft open at its two ends. The contact comprises a terminal, a member, a deformable conductor, and a movable contact head provided with an O-ring joint and connected to the terminal for connecting the member by way of said deformable conductor.

A retaining element is fixed to the deformable conductor. A helical spring surrounds the deformable conductor and is supported at a first end on the contact head and at a second end on the retaining element, the contact head being biased by the helical spring working in compression. At least one stationary tubular gasket is mounted in a bottom of the guiding shaft and extends through the bottom of the guiding shaft, the at least one stationary tubular gasket surrounding the terminal, at least partially, so as to encircle the member. The at least one stationary tubular gasket has an annular lip arranged between at least one of the retaining element and a portion connected thereto, and the bottom of the guiding shaft, such that an axial pressure from the helical spring is exerted on the lip. The retaining element comprises at least one washer that is supported on the annular lip of the at least one stationary tubular gasket.

According to another aspect of the invention, an apparatus comprises a guiding shaft open at its two ends and having a bottom. A axial-compression spring electrical contact has an impervious connection, adapted to be housed in the guiding shaft. The apparatus further comprises a terminal, a feeding cable, a deformable conductor, and a movable contact head connected to the terminal for connecting the feeding cable by way of the deformable conductor. A retaining element is housed in the bottom of the guiding shaft and is fixed to the deformable conductor. A helical spring surrounds the deformable conductor and is supported at a first end on the contact head and at a second end on the retaining element, the contact head being biased by the helical spring working in compression. At least one tubular gasket is stationarily mounted in the bottom of the guiding shaft, the at least one tubular gasket extending through the bottom of the guiding shaft and surrounding the terminal, at least partially, so as to encircle an outer sheath of the feeding cable.

The at least one tubular gasket has an annular lip arranged between at least one of the retaining element and a portion connected thereto, and the bottom of the guiding shaft, such that an axial pressure from the helical spring is exerted on the lip. The retaining element may comprises at least one washer supported on the annular lip of the at least one tubular gasket. The retaining element may constitute the terminal for connecting to the feeding cable. The feeding cable may comprise an electric feeding cable. The retaining element may comprise a sleeve which is fixed to the deformable conductor and is crossed by an extension of the deformable conductor at the end of which the terminal for connecting to the feeding cable is arranged, such that the terminal can be oriented due to the flexibility of the deformable conductor. The contact head may be further provided with an O-ring joint. The deformable conductor may be in the form of a braid which is deformable by compression.

According to a further aspect of the invention, an apparatus comprises a guiding shaft open at its two ends and having a bottom, an axial-compression spring electrical contact having an impervious connection adapted to be housed in the guiding shaft, a terminal, an electric feeding cable, and a deformable conductor. A movable contact head is connected to the terminal for connecting the feeding cable by way of the deformable conductor, the contact head being provided with an O-ring joint. A retaining element is housed in the bottom of the guiding shaft and fixed to the deformable conductor. A helical spring surrounds the deformable conductor and is supported at a first end on the contact head and at a second end on the retaining element, the contact head being biased by the helical spring working in compression. At least one tubular gasket is stationarily mounted in the bottom of the guiding shaft, the retaining element comprising at least one washer supported on the annular lip of the at least one tubular gasket, the at least one tubular gasket extending through the bottom of the guiding shaft and surrounding the terminal, at least partially, so as to encircle an outer sheath of the feeding cable. The at least one tubular gasket has an annular lip arranged between one of the retaining element, or a portion connected thereto, and the bottom of the guiding shaft, such that an axial pressure from the helical spring is exerted on the lip.

BRIEF DESCRIPTION OF DRAWINGS

The invention will be well understood upon reading the description that follows, with reference to the annexed drawings, in which.

DETAILED DESCRIPTION OF THE PREFERRED EMBODIMENTS

Figure 1:
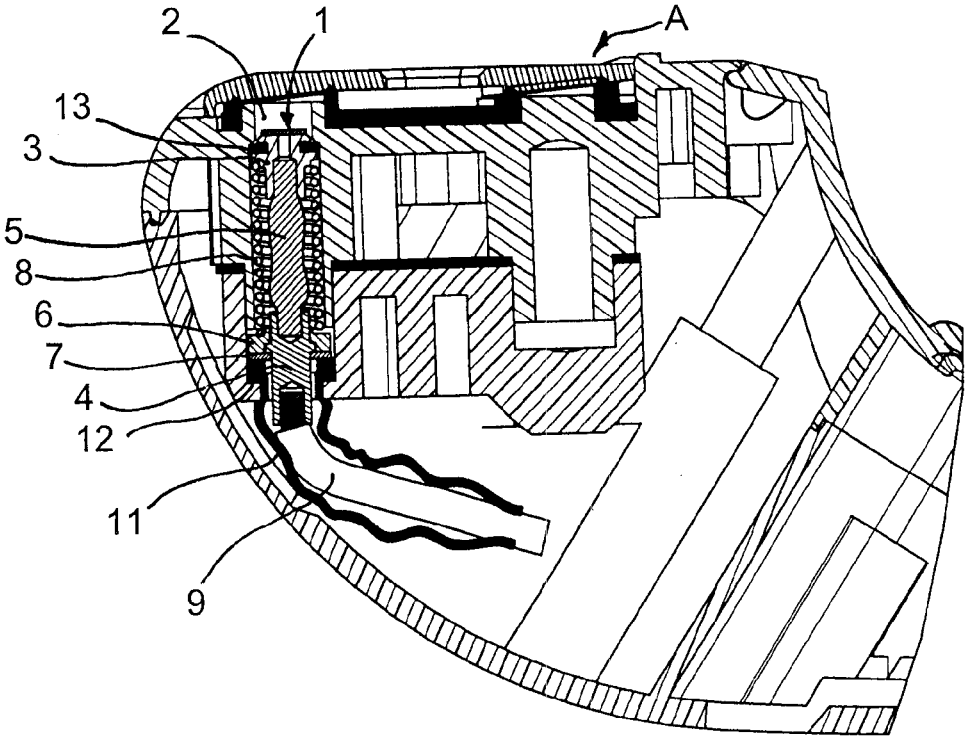
FIG. 1 shows in cross-section a portion of a coupler socket, provided with at least one contact according to the invention, FIG. 2 corresponds to FIG. 1, the contact here further having a connection that can be oriented according to a particular embodiment.

The Figures partially show an apparatus A to be equipped which, here, is a coupler socket provided with at least one contact 1 according to the invention.

Of course, the coupler socket shown is provided by way of example, and it could also be a surface socket.

The contact 1 is arranged in an insulating housing or guiding shaft 2, which is also called the contact support, provided in the apparatus A, the guiding shaft being open at its two ends.

The contact 1 includes a contact head 3 mounted so as to move longitudinally in the guiding shaft 2. As shown in the drawings, the contact head is retained in the shaft 2 by a narrowing of the latter, and it is electrically connected to a retaining element 4 (FIG. 1), 4' (FIG. 2), arranged in the bottom of the guiding shaft 2, by a conducting braid 5 that can be deformed by compression.

The retaining element here further includes two washers 6, 7, the upper washer 6 being slit for assembly and manufacture purposes.

A helical spring 8 working in compression is arranged around the braid 5 between a bearing surface of the contact head 3 and the upper washer 6 of the retaining element 4.

In this way, it is understood that the spring 8 biases the contact head 3 to the position shown, i.e., toward the corresponding opening of the guiding shaft 2, the contact head being provided as mentioned previously to elastically engage, due to the spring 8, with an opposing contact not shown.

Such a contact is of course provided to be connected to an electric feeding cable arranged in the apparatus, such as the cable 9.

In the embodiment of FIG. 1, the retaining element 4 conventionally constitutes a connecting terminal for the cable 9, the terminal being fixed on the braid 5, for example, by crimping or soldering.

Figure 2:
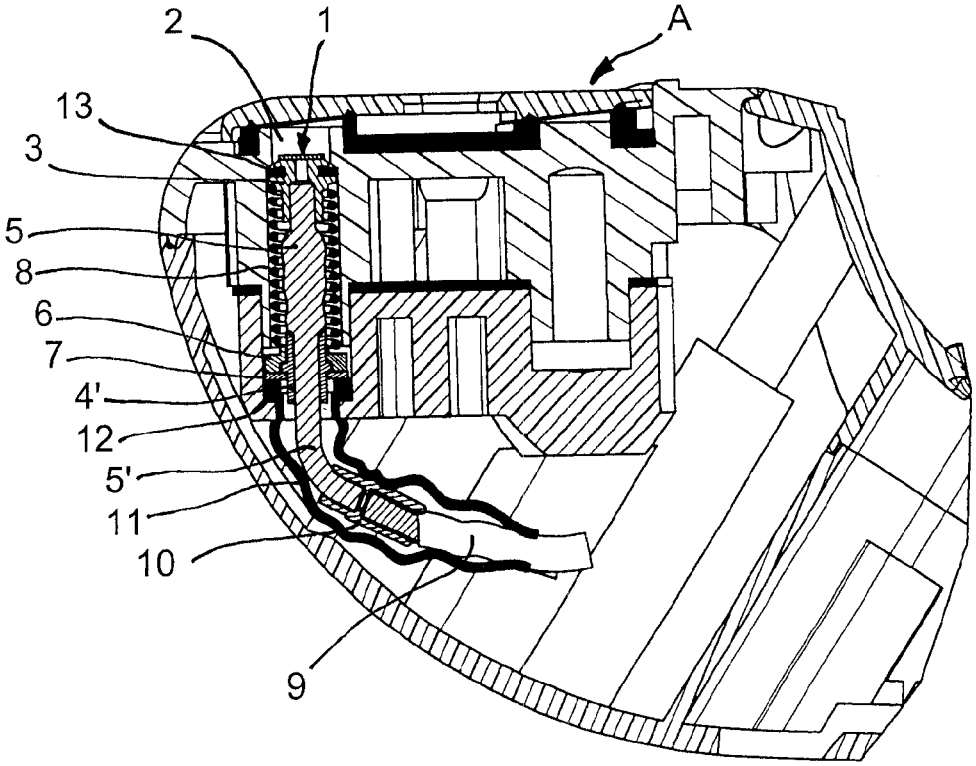

In the particular embodiment of FIG. 2, the connection can be oriented and, to this end, the retaining element 4' is a sleeve that is also crimped or soldered on the braid 5, and the braid has an extension 5' that extends through the sleeve 4' and comes out of the guiding shaft 2, whereas it is the end of the extension 5' of the braid that is provided with a terminal 10 for connecting to the cable 9, such that the terminal 10 can be oriented due to the flexibility of the braid.

The connecting terminals 4 or 10 are provided with any appropriate device to ensure the connection, such as a tightening screw or the like, short of a connection by crimping or soldering.

Therefore, to seal and/or insulate the connection of the contact, the invention provides a flexible tubular gasket 11 provided with a lip 12.

The lip 12 is arranged between the lower washer 7 of the retaining element 4, 4' (connecting terminal 4 according to FIG. 1, or sleeve 4' according to FIG. 2) and the bottom of the guiding shaft 2.

The gasket 11 partially surrounds the retaining element 4, 4', as well as the extension 5' of the braid 5 and the connecting terminal 10 in the case of the embodiment of FIG. 2; it then encircles the outer sheath of the feeding cable 9.

In this last embodiment, the extension of the braid is thus protected.

It is readily understood that the lip 12 of the gasket 11 is compressed by the effect of the spring and thus ensures the desired imperviousness.

To complete this imperviousness, the contact head 3 further includes an O-ring joint 13, as shown in the drawings.

The gasket 11 is, for example, a single piece made of rubber, which can be rolled up advantageously to facilitate the connections, but it could also be made of a plurality of parts of various types.

An imperviousness is thus obtained between the insulator in which the guiding shaft is arranged and the outer sheath of the cable 9.

As mentioned previously, the gasket, with a small space requirement, not only ensures the aforementioned imperviousness, but also the electrical insulation from adjacent contacts.

What is claimed is:

1. An electrical contact having an impervious connection, adapted to be housed in a guiding shaft having two open ends, said contact comprising:

a terminal;

a member;

a deformable conductor;

a movable contact head connected to said terminal for connecting the member by way of said deformable conductor;

a retaining element fixed to the deformable conductor;

a helical spring surrounding said deformable conductor and being supported at a first end on the contact head and at a second end on the retaining element, the contact head being biased by said helical spring working in compression; and at least one stationary tubular gasket mounted in a bottom of the guiding shaft, extends through said bottom of the guiding shaft and surrounds the terminal, at least partially, so as to encircle said member.

2. The electrical contact according to claim 1, wherein the at least one stationary tubular gasket has an annular lip arranged between at least one of the retaining element and a portion connected thereto, and the bottom of the guiding shaft, such that an axial pressure from the helical spring is exerted on said lip.

3. The electrical contact according to claim 2, wherein the retaining element comprises at least one washer that is supported on the annular lip of the at least one stationary tubular gasket.

4. The electrical contact according to claim 1, wherein the retaining element comprises a sleeve which is fixed to the deformable conductor and is crossed by an extension of said deformable conductor at an end of which the terminal for connecting to the member is arranged, such that said terminal can be oriented due to deformability of the deformable conductor.

5. The electrical contact according to claim 1, wherein the contact head is further provided with an O-ring joint.

6. The electrical contact according to claim 1, wherein the deformable conductor is in a form of a braid which can be deformed by compression.

7. The electrical contact according to claim 1, wherein said terminal is connected to said member.

8. The electrical contact according to claim 7, wherein said member comprises a feeding cable.

9. The electrical contact according to claim 8, wherein said feeding cable comprises an electric feeding cable.

10. The electrical contact according to claim 9, wherein said retaining element constitutes the terminal being connected to the electric feeding cable.

11. An electrical contact having an impervious connection, adapted to be housed in a guiding shaft having two open ends, and comprising:

a terminal;

a member;

a deformable conductor;

a movable contact head provided with an O-ring joint and connected to said terminal for connecting the member by way of said deformable conductor;

a retaining element fixed to the deformable conductor;

a helical spring surrounding said deformable conductor and being supported at a first end on the contact head and at a second end on the retaining element, the contact head being biased by said helical spring working in compression; and at least one stationary tubular gasket mounted in a bottom of the guiding shaft and extending through said bottom of the guiding shaft, said at least one stationary tubular gasket surrounding the terminal, at least partially, so as to encircle said member, the at least one stationary tubular gasket having an annular lip arranged between at least one of the retaining element and a portion connected thereto, and the bottom of the guiding shaft, such that an axial pressure from the helical spring is exerted on said lip, wherein the retaining element comprises at least one washer that is supported on the annular lip of the at least one stationary tubular gasket.

12. An apparatus comprising:

a guiding shaft having two open ends and having a bottom;

an axial-compression spring electrical contact having an impervious connection, adapted to be housed in said guiding shaft;

a terminal;

a feeding cable;

a deformable conductor;

a movable contact head connected to said terminal for connecting the feeding cable by way of said deformable conductor;

a retaining element housed in the bottom of the guiding shaft and fixed to the deformable conductor;

a helical spring surrounding said deformable conductor and being supported at a first end on the contact head and at a second end on the retaining element, the contact head being biased by said helical spring working in compression; and at least one tubular gasket stationarily mounted in the bottom of the guiding shaft, said at least one tubular gasket extending through said bottom of the guiding shaft and surrounding the terminal, at least partially, so as to encircle an outer sheath of the feeding cable.

13. The apparatus according to claim 12, wherein the at least one tubular gasket has an annular lip arranged between at least one of the retaining element and a portion connected thereto, and the bottom of the guiding shaft, such that an axial pressure from the helical spring is exerted on said lip.

14. The apparatus according to claim 13, wherein the retaining element comprises at least one washer supported on the annular lip of the at least one tubular gasket.

15. The apparatus according to claim 14, wherein the retaining element constitutes the terminal for connecting to the feeding cable.

16. The apparatus according to claim 12, wherein the feeding cable comprises an electric feeding cable.

17. The apparatus according to claim 12, wherein the retaining element comprises a sleeve which is fixed to the deformable conductor and is crossed by an extension of said deformable conductor at an end of which the terminal for connecting to the feeding cable is arranged, such that said terminal can be oriented due to a flexibility of the deformable conductor.

18. The apparatus according to claim 12, wherein the contact head is further provided with an O-ring joint.

19. The apparatus according to claim 12, wherein the deformable conductor is in a form of a braid which is deformable by compression.

20. An apparatus comprising:

a guiding shaft having two open ends and having a bottom;

an axial-compression spring electrical contact having an impervious connection, adapted to be housed in said guiding shaft;

a terminal;

an electric feeding cable;

a deformable conductor;

a movable contact head connected to said terminal for connecting the feeding cable by way of said deformable conductor, the contact head being provided with an O-ring joint;

a retaining element housed in the bottom of the guiding shaft and fixed to the deformable conductor;

a helical spring surrounding said deformable conductor and being supported at a first end on the contact head and at a second end on the retaining element, the contact head being biased by said helical spring working in compression; and at least one tubular gasket stationarily mounted in the bottom of the guiding shaft, the retaining element comprising at least one washer supported on the annular lip of the at least one tubular gasket, said at least one tubular gasket extending through said bottom of the guiding shaft and surrounding the terminal, at least partially, so as to encircle an outer sheath of the feeding cable, said at least one tubular gasket having an annular lip arranged between one of the retaining element, or a portion connected thereto, and the bottom of the guiding shaft, such that an axial pressure from the helical spring is exerted on said lip.

* * * * *